United States Patent [19]

Olds

[11] 3,942,215

[45] Mar. 9, 1976

[54] FLOOR MAINTENANCE MACHINE

[76] Inventor: James O. Olds, 145-18 105th Ave., Jamaica, N.Y. 11435

[22] Filed: Aug. 29, 1974

[21] Appl. No.: 501,647

Related U.S. Application Data

[63] Continuation-in-part of Ser. No. 305,835, Nov. 13, 1972, abandoned.

[52] U.S. Cl. ..... 15/320; 15/340

[51] Int. Cl.[2] ..... A47L 7/00

[58] Field of Search ..... 15/320, 340; 180/6.2

[56] References Cited

UNITED STATES PATENTS

| | | | |
|---|---|---|---|
| 1,736,446 | 11/1929 | Keefer | 15/320 X |
| 2,622,254 | 12/1952 | Mendelson | 15/320 X |
| 3,204,280 | 9/1965 | Campbell | 15/320 X |
| 3,383,950 | 5/1968 | Kershner | 180/6.2 X |
| 3,467,212 | 9/1969 | Doll | 180/6.2 |
| 3,823,791 | 7/1974 | Sheler | 180/6.2 X |

*Primary Examiner*—Daniel Blum
*Assistant Examiner*—C. K. Moore
*Attorney, Agent, or Firm*—Daniel Jay Tick

[57] ABSTRACT

A floor maintenance machine comprises a platform mounted on wheels. An electric power system on the platform is coupled to some of the wheels for driving the machine. A steering system on the platform is coupled to selected ones of the wheels for steering the machine. A vacuum system on the platform is connected to and operated by the electric power system for vacuuming a floor on which the machine is driven. A brushing system on the platform is connected to and operated by the electric power system for performing operations on the floor. The brushing system comprises a plurality of brushes selectively manually coupled to the brushing system for selectively washing, waxing and buffing the floor. A washing system on the platform washes the floor. The washing system comprises a storage drum having two independent compartments, one containing a detergent and water solution and the other containing rinse water when washing and liquid wax when waxing. A waxing system on the platform is connected to and operated by the electric power system for waxing the floor. A vehicle control system is coupled to the electric power system for controlling the movement of the machine. A machine control system is coupled to the electric power system for selectively controlling the operation of the vacuum system, the brushing system and the waxing system.

5 Claims, 14 Drawing Figures

173
201

170

149
153
154
152

55
57
56
58
54
59
94
149
115
10
167
175
173
176
147
174
1
13
12
29
171
39
41
43

FLOOR MAINTENANCE MACHINE

DESCRIPTION OF THE INVENTION

This is a Continuation-in-Part of application Ser. No. 305,835, filed Nov. 13, 1972, and now abandoned, for FLOOR MAINTENANCE MACHINE.

The present invention relates to a floor maintenance machine.

The principal object of the invention is to provide a floor maintenance machine which selectively vacuums, brushes, washes, waxes and buffs a floor.

An object of the invention is to provide a self-propelled floor maintenance machine which is compact and functions to selectively vacuum, brush, wash, wax and buff a floor with efficiency, effectiveness and reliability.

In order that the invention may be readily carried into effect, it will now be described with reference to the accompanying drawings, wherein.

Figure 1:
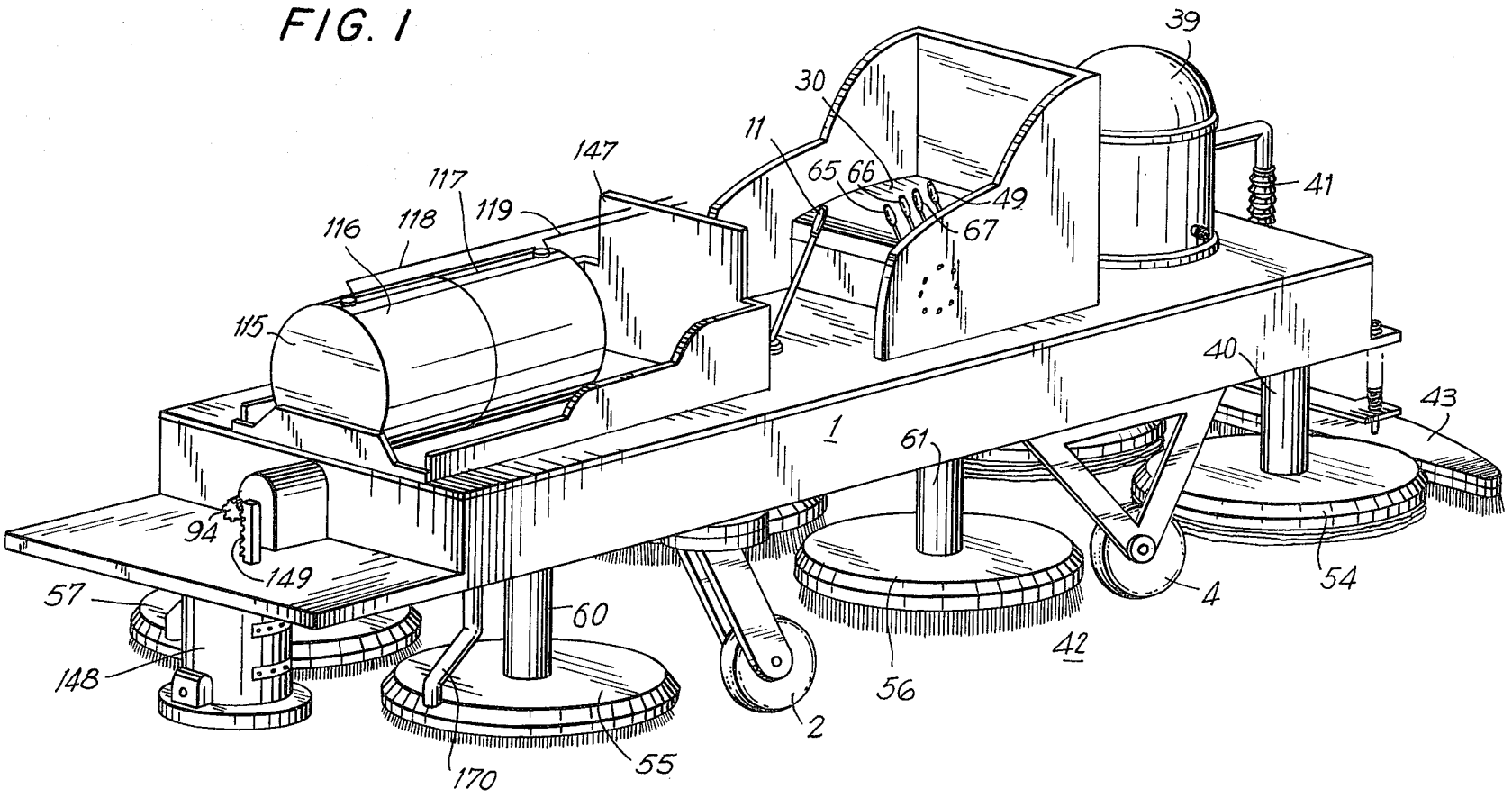
FIG. 1 is a schematic diagram of an embodiment of the floor maintenance machine of the invention.
Figure 2:
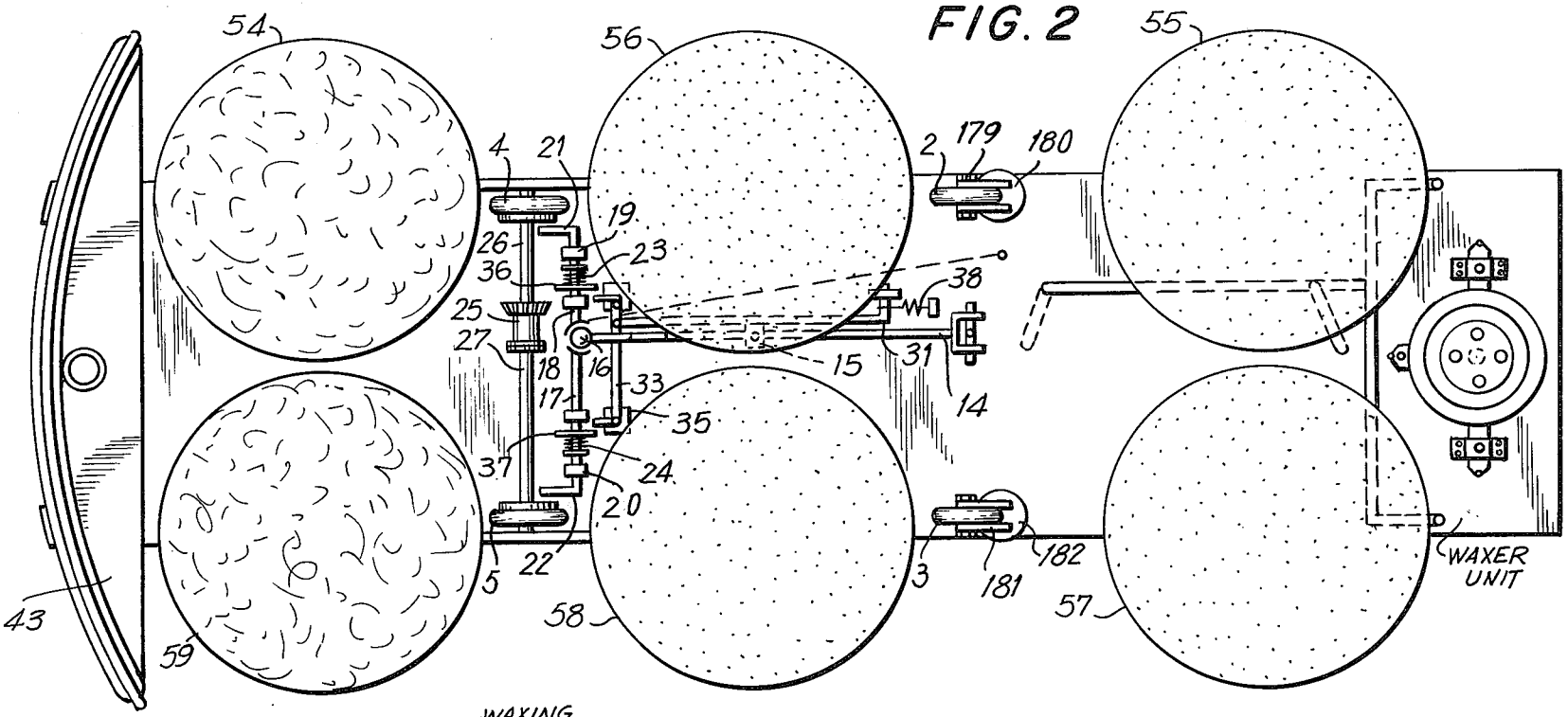
FIG. 2 is a schematic diagram of the steering and braking system of the floor maintenance machine of the invention.

The floor maintenance machine of the invention comprises a platform 1 mounted on wheels 2, 3, 4 and 5 (FIGS. 1 and 2).

An electric power system (FIG. 3) is mounted on the platform 1 on the surface thereof and is coupled to the rear wheels 4 and 5, for driving the machine.

Figure 3:
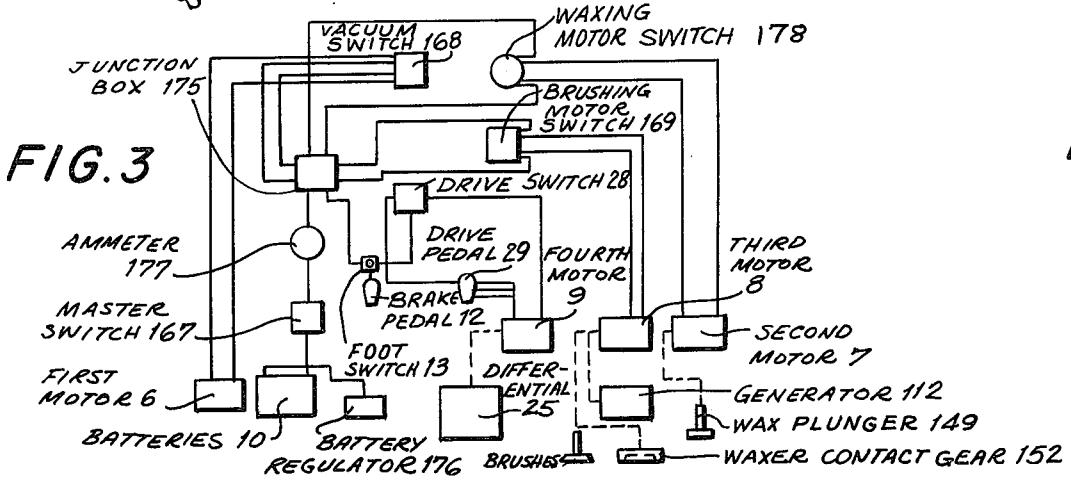
FIG. 3 is a circuit diagram of the power and drive system of the floor maintenance machine of the invention.

The electric power system preferably comprises four DC motors 6, 7, 8 and 9 driven by batteries 10, as shown in FIG. 3. A first motor 6 is coupled to and drives the vacuum system. A second motor 7 is coupled to and drives the waxing system. A third motor 8 is coupled to and drives the brushing system. The fourth motor 9 is coupled to the wheels 4 and 5 and drives or moves the platform or vehicle, via said wheels.

A steering system on the platform 1 is also coupled to the rear wheels 4 and 5 and functions to steer the platform or vehicle, as shown in FIG. 2. The steering system includes a guide stick 11 for steering the vehicle by moving said stick in the desired direction. The machine also includes a brake system having a brake pedal 12 for operating the brakes of the wheels 4 and 5, as shown in FIG. 2, and a foot switch 13 (FIG. 3) for opening the circuit between the fourth motor 9 and the energizing batteries 10 of the electric power system for an emergency stop. The drive system of the vehicle has three forward speeds and a reverse speed in the manner of known transmission systems.

The platform 1 is steered by the guide stick 11 mounted thereon, by side to side movement. The bottom of the guide stick 11 extends through the platform 1 to its underside and fits into a bracket end of a guide rod 14, as shown in FIG. 2. The guide rod 14 is mounted in a guide rod support 15 in a manner whereby its ends swing from side to side. The guide rod 14 has a ball-shaped end 16 which fits between two brake shafts 17 and 18 which are spaced to accommodate the ball-shaped end between them, as shown in FIG. 2. The brake shafts 18 and 17 are mounted on supports 19 and 20, respectively, in front of the rear wheels 4 and 5, respectively, so that the brake shoe ends 21 and 22 of the brake shafts 18 and 17, respectively, may come in contact with rims of the wheels 4 and 5 when the guide stick is moved left or right. Springs 23 and 24 are supported on the brake shafts 18 and 17, respectively, in a manner whereby they push the brake shafts 18 and 17 back into position when the guide stick 11 is released. When the guide stick 11 is moved to the left, the left rear wheel 4 is braked and the machine moves to the left. When the guide stick is moved to the right, the right rear wheel 5 is braked and the machine moves to the right.

The machine is driven by the fourth motor 9 (FIG. 3) which is mounted on the platform 1. The fourth motor 9 is connected to a ring gear of a differential assembly 25 (FIGS. 2 and 3) via gears and rear wheel axles 26 and 27 (FIG. 2). The fourth motor 9 is controlled by a three speed transmission type switch 28, operated by a drive pedal 29 (FIG. 3), in the area of the driver's seat 30 (FIG. 1).

A brake system, operated by a brake pedal 12 in the area of the driver's seat 30, functions to stop the machine. the brake pedal 12 has a switch 13 thereon which opens the energizing circuit of the fourth motor 9 when said pedal is depressed, as shown in FIG. 3. The bottom end of the brake pedal 12 is coupled to a brake rod 31 (FIGS. 2 and 6) under the platform 1. The brake rod 31 is connected to brake arms 32 and 33 mounted on brake arm supports 34 and 35, respectively, which swing into contact with brake rings 36 and 37, respectively, on the brake shafts 18 and 17, respectively, as shown in FIG. 2 when the brake pedal is depressed. A spring 38 (FIG. 2) connected to the brake rod 31 moves the brake pedal 12 back into position when said pedal is released.

A vacuum system is mounted on the platform 1 at the rear thereof and is connected to and operated by the first motor 6. The vacuum system comprises a vacuum machine 39 and a vacuum-wash attachment 43 coupled to the vacuum machine via a hose arrangement 41 (FIG. 1). The vacuum system vacuums the floor 42 (FIG. 1) on which the machine is driven.

Figure 4:
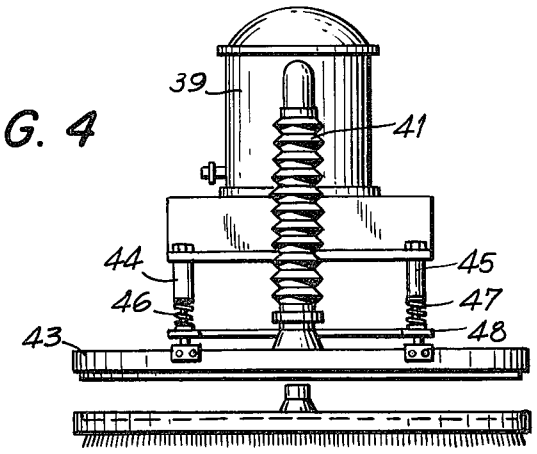
FIG. 4 is a view of the vacuum system of the floor maintenance machine of the invention.
Figure 5:
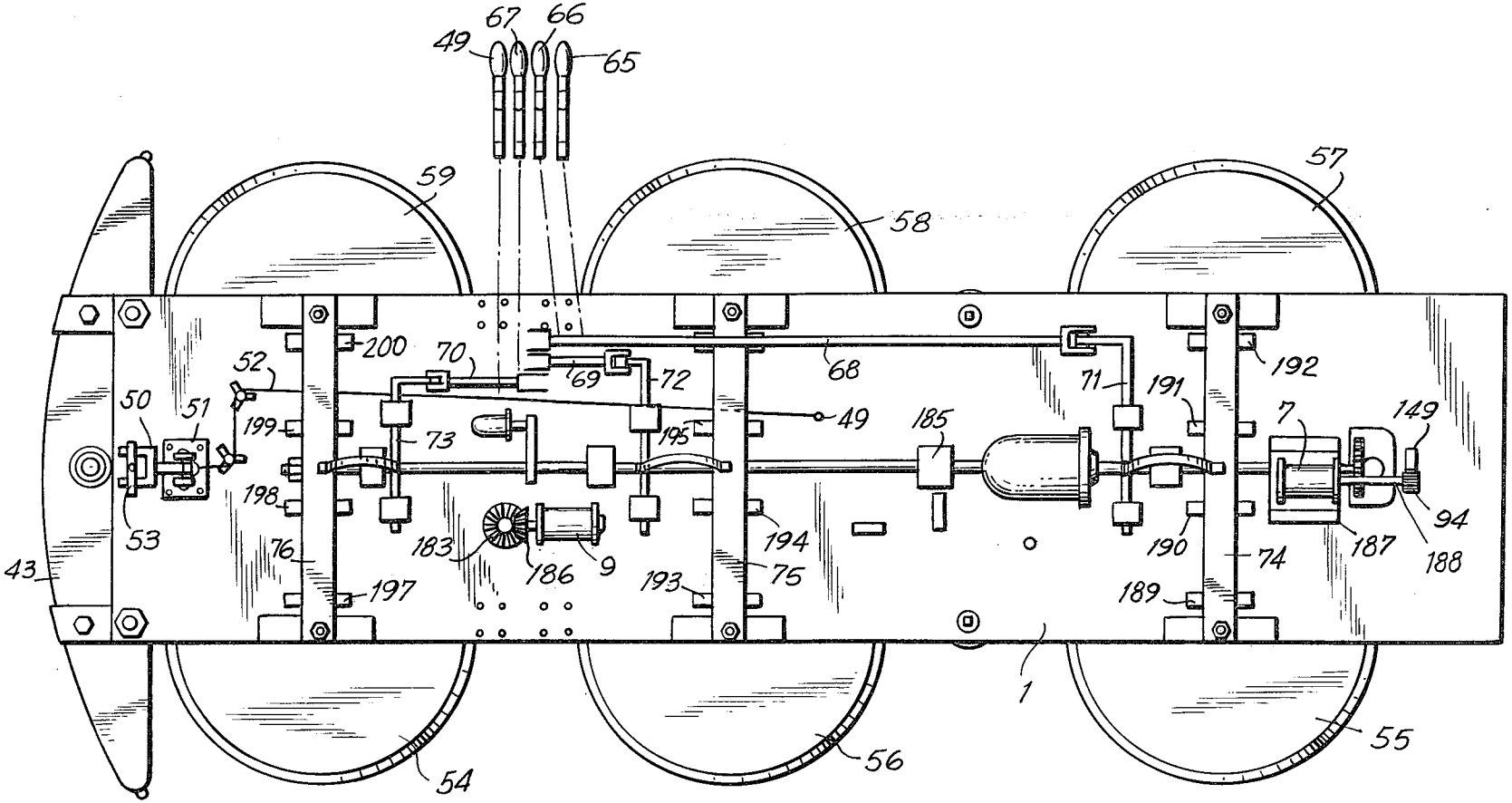
FIG. 5 is a schematic diagram of the waxing, brushing and buffing control systems of the floor maintenance machine of the invention.

The vacuum machine 39 comprises any suitable known vacuum machine and is affixed to the platform 1 by guide rods 44 and 45, guide springs 46 and 47, and a lift member 48, as shown in FIG. 4. The vacuum machine 39 moves up and down in accordance with the operation of a vacuum control lever 49 (FIG. 1). A vacuum lift 50 is mounted on a lift support 51 at the rear of the platform 1 and is connected to the vacuum control lever 49 by a control cable 52, as shown in FIG. 5. The vacuum lift 50 is controlled by a vacuum lift rod 53 (FIG. 5).

Figure 6:
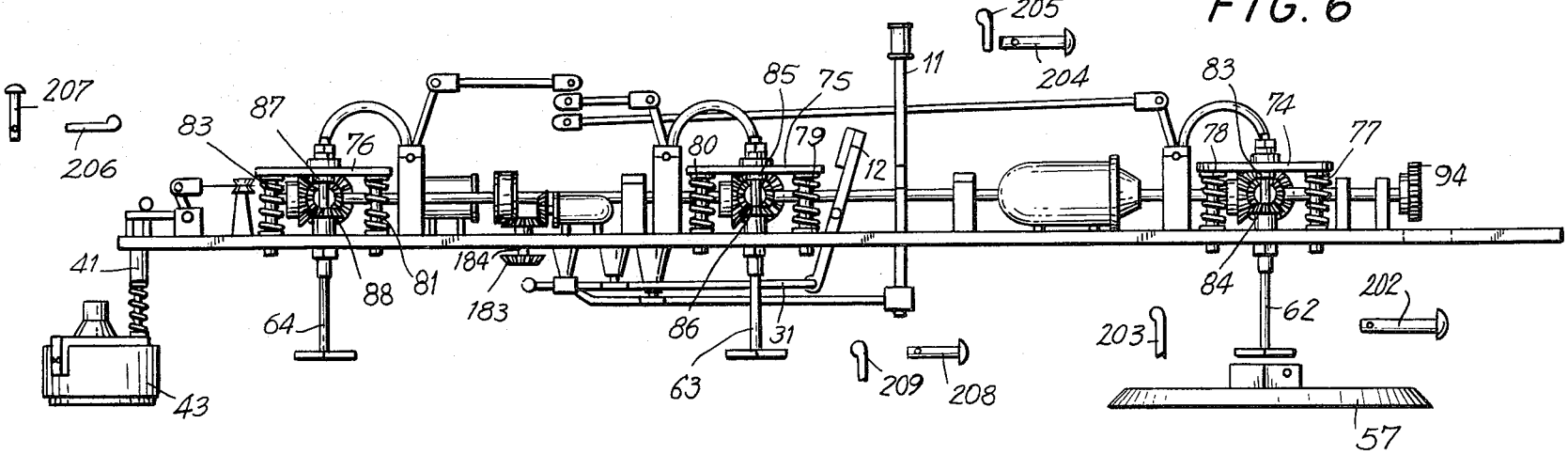
FIG. 6 is a view of the waxing, brushing and buffing control systems of the floor maintenance machine of the invention.

The vacuum-wash attachment 43 has a flexible material around its rim so that it draws particles off the floor due to the vacuum produced by the vacuum machine 39. The vacuum-wash attachment 43 is supported at the end of the hose arrangement 41 (FIGS. 1, 4 and 6).

A brushing system on the platform 1 is connected to and operated by the third motor 8 of the electric power system and may be used to brush and buff the floor 42, as desired. The brushing system comprises a plurality of brushes 54, 55, 56, 57, 58 and 59, as well as the vacuum-wash attachment 43 (FIGS. 1, 2, 4 and 5). Each of the brushes 54, 55, 56, 57, 58 and 59 is rotatably mounted on its own shaft 40, 60, 61, 62, 63 and 64, respectively, of which the shafts 60, 61 and 40 are shown in FIG. 1, and may be raised or lowered, as desired, to move up out of contact with the floor, or down into contact with the floor. The raising and lowering of the brushes is controlled by manually operated levers 65, 66 and 67 (FIG. 1). The third motor 8 rotates all the brushes simultaneously, and has two speeds.

The bottoms of the levers 65, 66 and 67 are coupled to push rods 68, 69 and 70, respectively (FIG. 5), selectively control the waxing, brushing and buffing operations of the machine. The push rods 68, 69 and 70, respectively (FIG. 5), and selectively control the waxing, brushing and buffing operations of the machine. The push rods 68, 69 and 70 are connected to push rockers 71, 72 and 73, respectively, supported by the platform 1, as shown in FIG. 5. When; the levers 65, 66 and 67 are moved into position to bring the brushes into contact with the floor, the necks, or extended parts, of the push rockers 71, 72 and 73 move a waxing cross bar 74, a brushing cross bar 75 and a buffing cross bar 76, respectively, as shown in FIG. 5, mounted over the tops of the brush shafts 60, 61, 40, 62, 63 and 64. The cross bars 74, 75 and 76 (FIGS. 5 and 6) are spring-mounted via springs 77, 78, 79, 80, 81, 82, and so on, as shown in FIG. 6. When the levers 65, 66 and 67 are released, the springs 77 to 82, and so on, move the brushes out of contact with the floor by raising the shafts 60, 61, 40, 62, 63 and 64 of the brushes. The right front brush unit has a shaft spool 83 and a shaft sleeve 84 (FIG. 6). The right center brush unit has a shaft spool 85 and a shaft sleeve 86 (FIG. 6). The right rear brush unit has a shaft spool 87 and a shaft sleeve 88 (FIG. 6).

Figure 7:
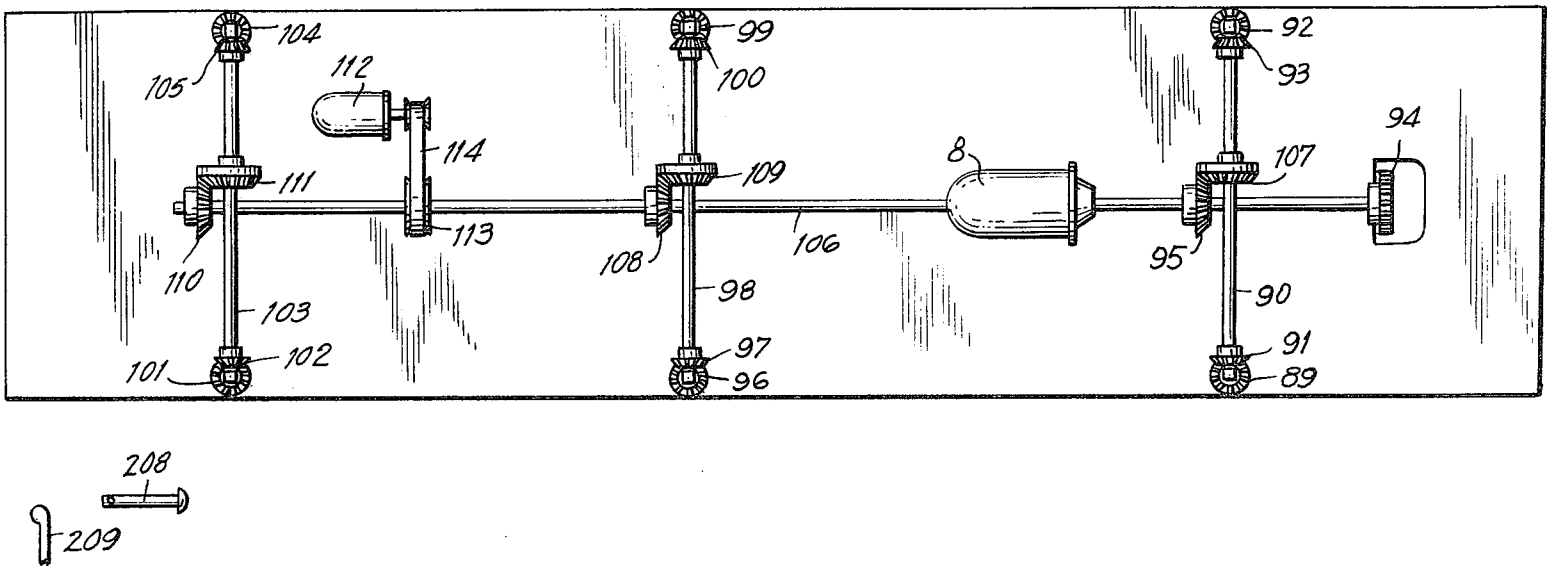
FIG. 7 is a schematic diagram of the brushing system of the floor maintenance machine of the invention.

The right front brush unit has a shaft gear 89, a waxing axle 90 and an axle end gear 91 (FIG. 7). The left front brush unit has a shaft gear 92 and an axle end gear 93 (FIG. 7). A shaft waxer gear 94 is coupled to a shaft waxing gear 95 (FIG. 7). The right center brush unit has a shaft gear 96, an axle end gear 97 and a brushing axle 98 (FIG. 7). The left center brush unit has a shaft gear 99 and an axle end gear 100 (FIG. 7). The right rear brush unit has a shaft gear 101, an axle end gear 102 and a buffing axle 103. The left rear brush unit has a shaft gear 104 and an axle end gear 105 (FIG. 7).

As shown in FIG. 7, the brushing motor 8 drives a brushing motor shaft 106, which drives the waxing axle 90 via the shaft waxing gear 95 and a center gear 107, drives the brushing axle 98 via a shaft brushing gear 108 and a center gear 109, and drives the buffing axle 103 via a shaft buffing gear 110 and a center gear 111. A generator 112 is driven by the brushing motor shaft 106 via a roller 113 and a drive belt 114, as shown in FIG. 7.

Figure 8:
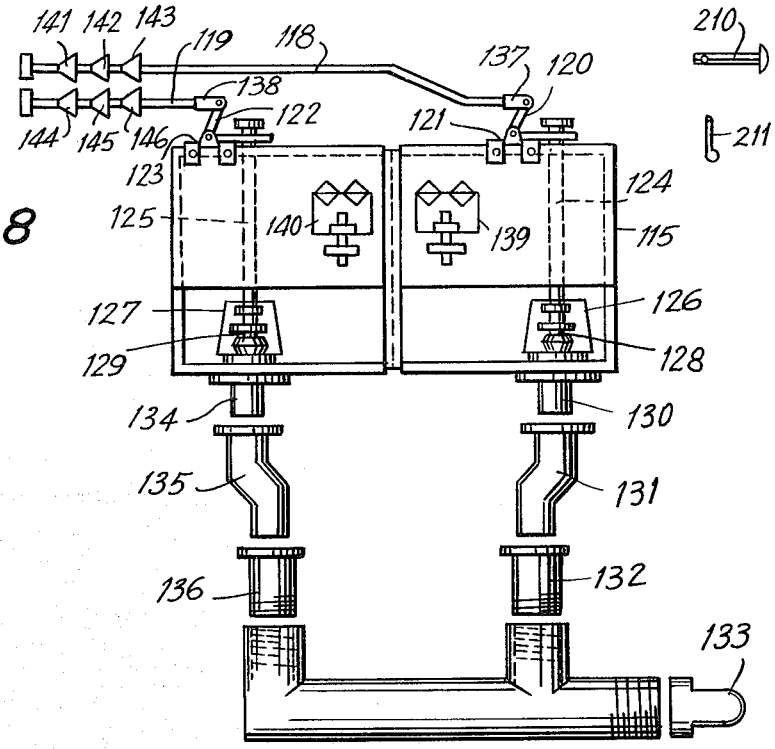
FIG. 8 is a schematic diagram of the washing system of the floor maintenance machine of the invention.

A washing system on the platform 1 is utilized to wash the floor 42. The washing system comprises a water tank 115 mounted on the upper surface of the platform 1, which tank is divided into a front part 116 for storing washing water and a rear part 117 for storing rinsing water (FIG. 1). The flow of water from the tank 115 is controlled by a washing rod 118 extending into the front part 116 and a rinsing rod 119 extending into the rear part 117, as shown in FIGS. 1 and 8.

The rods 118 and 119 are connected to a plunger lift 120 (FIG. 8) mounted on the front of the tank 115 and supported by a front plunger lift support 121, and a plunger lift 122 (FIG. 8) mounted on the rear of the tank and supported by a rear plunger lift support 123. The plunger rods 118 and 119 extend through holes in the top of the tank 115 and are supported by the plunger lifts 120 and 122, respectively. A front plunger and rod 124 and a rear plunger and rod 125 fit into corresponding holes in the bottom of the tank 115 and are guided by a front plunger guide 126 and a rear plunger guide 127, respectively, as shown in FIG. 8. A front plunger spring 128 in the front plunger guide 126 and a rear plunger spring 129 in the rear plunger guide 127, respectively, move the plungers 124 and 125 (FIG. 8). A front plunger pipe 130 from the front hole at the bottom of the tank 115 is connected to a front tank pipe 131, which is connected to a front frame pipe 132, which is connected to a front end pipe divider 133, as shown in FIG. 8. A rear plunger pipe 134 from the rear hole at the bottom of the tank 115 is connected to a rear tank pipe 135, which is connected to the pipe divider 133 via a rear frame pipe 136, as shown in FIG. 8. The washing rod 118 is coupled to the front plunger and rod 124 via a washing rod yoke 137 and the rinsing rod 119 is coupled to the rear plunger and rod 125 via a rinsing rod yoke 138 (FIG. 8). A pair of tank doors 139 and 140 (FIG. 8) are provided to permit access to the tank 115.

When the washing and rinsing rods 118 and 119 are pulled back, by the operator of the machine, the corresponding front and rear plungers 124 and 125 are raised, permitting the water to flow to the floor via the pipe divider 133, on the underside of the platform 1. Small holes are formed in the top of the tank 115 at the front and rear parts 116 and 117, respectively, to permit the water to flow by gravitational force. The flow of water is adjusted by positioning a selected one of a plurality of protrusions 141, 142 and 143 on the rod 118 and 144, 145 and 146 on the rod 119 (FIG. 8) in cooperating grooves in a supporting part 147 (FIG. 1) of the platform 1.

Figure 9:
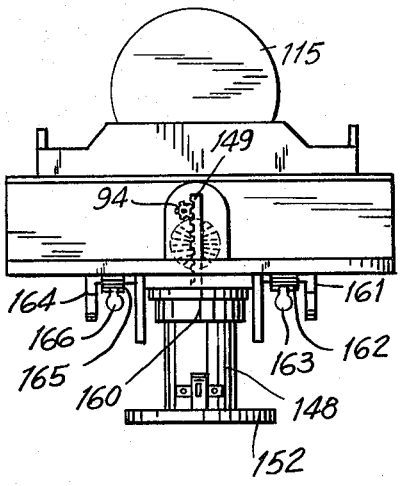
FIG. 9 is a front view of the waxing system of the floor maintenance machine of the invention.
Figure 10:
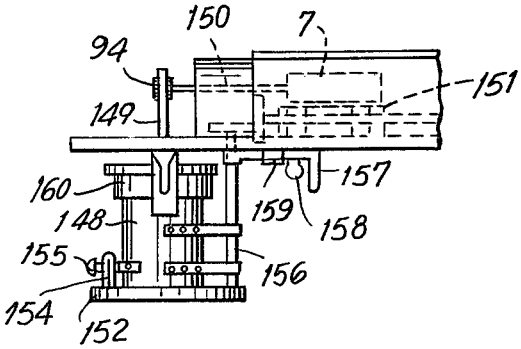
FIG. 10 is a side view of the waxing system of the floor maintenance machine of the invention.

A waxing system on the platform 1 is connected to and operated by the second motor 7 (FIGS. 3 and 10). The waxing system comprises a wax drum 148 (FIGS. 1, 9 and 10) mounted at the front of the vehicle which may be raised or lowered by a waxing motor switch 178

(FIG. 3), as desired, to move up out of contact with the floor, or down into contact with the floor. A waxer contact gear 152 is rotated by the third motor 8, which rotates the brushes. The second motor 7 controls the vertical movement of the wax drum 148 and a wax plunger 149 via a motor shaft 150, as shown in FIG. 10. The motor 7 is supported by a motor support 151 (FIG. 10). The wax plunger 149 extends into the wax drum 148. The third or brush motor 8 rotates the waxer contact gear 152 (FIGS. 9, 10 and 11) on the bottom of the wax drum 148 and said gear rotates a wax carrier or butterfly worm 143, shown in FIG. 11, in the wax drum 148. The wax plunger 149 and the brushing motor shaft 106 (FIG. 7) are coupled via the shaft waxer gear 94, shown in FIGS. 7 and 9.

Figures 11, 12, 13, 14:
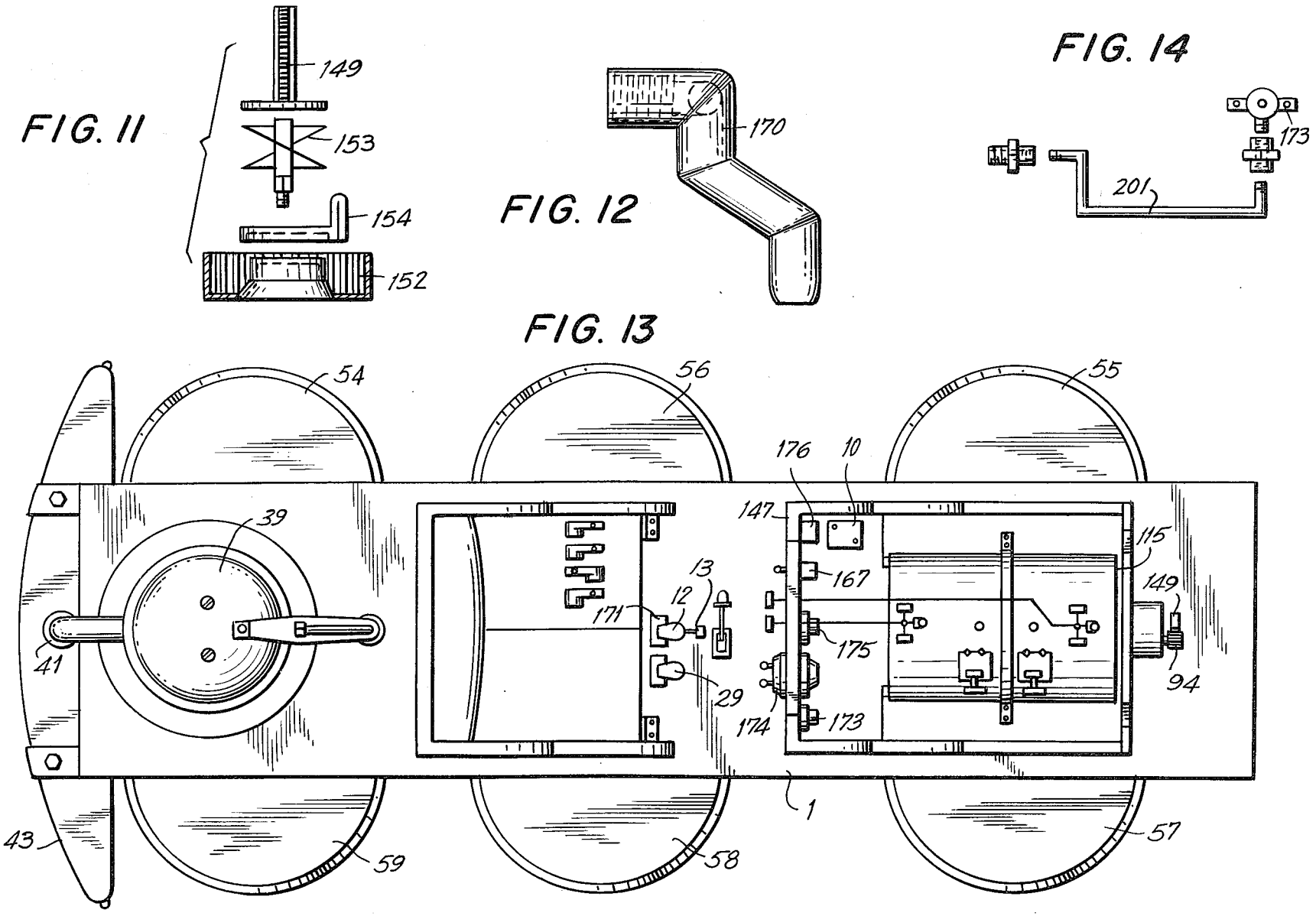
FIG. 11 is an exploded view, on an enlarged scale, of components of the waxing system of the floor maintenance machine of the invention.
FIG. 12 is a view, on an enlarged scale, of a component of the washing system of the floor maintenance machine of the invention.
FIG. 13 is a schematic diagram of the drive and control system of the floor maintenance machine of the invention.
FIG. 14 is an exploded view, on an enlarged scale, of components of the vacuum system of the floor maintenance machine of the invention.

A waxer gage or disc 154 at the bottom of the wax drum 158 is set to control the application of paste wax from the drum (FIGS. 10 and 11). The waxer gage 154 is set by a gage set screw 155 and the waxer contact gear 152 is coupled to the motor 8 via a waxer connecting shaft and gears 156, as shown in FIG. 10. A waxer thrust bar 157 is supported by a thrust bar clamp 158 and is set by a thrust bar set screw 159, as shown in FIG. 10. The wax drum 148 is covered by a cover 160 (FIGS. 9 and 10).

A left waxer support arm 161, support arm clamp 162 and clamp set screw 163 and a right waxer support arm 164, support arm clamp 165 and clamp set screw 166 are provided, as shown in FIG. 9.

A vehicle control system, shown in FIGS. 2 and 3, is coupled to the fourth motor 9 (FIG. 3) of the electric power system and controls the movement of the vehicle or platform 1. A machine control system, which includes the manually operated levers 49, 65, 66 and 67 (FIGS. 1 and 5), shown in FIGS. 4, 5, 6, 7, 8, 9, 10 and 11, is coupled to the first, second and third motors 6, 7 and 8, respectively, of the electric power system, as shown in FIG. 3, for selectively controlling the operation of the vacuum system, the brushing system and the waxing system.

The driver's seat 30 is affixed to the top surface of the platform 1 in the area of the manually operated levers 49, 65, 66 and 67 (FIG. 1).

When the machine is to be used for vacuuming and sweeping the floor, the brushing brushes are mounted on their respective shafts. The manual control levers are operated to lower the brushes downward to the floor and to lower the sweeping or vacuum attachment 43 downward to the floor. A master switch 167, a vacuum switch 168 and a brushing motor switch 169, as shwon in FIG. 3, are operated to energize the systems.

When the machine is to be used for washing the floor, the sweeping or vacuum-wash attachment 43 is raised (FIG. 1). The front part 116 of the tank 115 is filled with detergent and water and the rear part 117 of said tank is filled with rinse water.

When the floor is to be paste waxed, the sweeping brushes are removed from the corresponding shafts and are replaced by waxing brushes. The wax drum 148 is filled with wax and the wax drum is lowered downward to the floor by the waxing motor switch 178 and the waxing brushes are lowered downward to the floor 42 by the manual control levers. The brushes 56 and 58 are illustrated as sweeping brushes and the brushes 54 and 59 are illustrated as buffing brushes in FIG. 2. The brushes 55 and 57 are paste waxing brushes. Each transverse pair of brushes may be lowered separately to perform a specific function, or each pair of brushes may be operated to perform the same function. As shown in FIGS. 1 and 2, the machine of the invention performs a one trip operation to simultaneously sweep, paste, wax and buff. The machine may be adjusted to perform a single function with all six brushes being the same, however. When the machine is used for washing a floor, the sweeping attachment is removed from the bottom of the vacuum-wash attachment 43 and said vacuum-wash attachment is lowered to the floor. All six brushes are then sweeping brushes.

When the machine is to be used for liquid waxing, the tank 115 is filled with a liquid wax mixture.

When the machine is to be used for brushing and buffing, the wax drum 148 and the waxing brushes are removed. The waxing brushes are replaced by the desired brushes.

When the machine is to be used for stripping, the buffing and brushing brushes are removed and replaced by stripping pads and the washing system is placed in operation.

A front end pipe 170, as shown in FIGS. 1 and 12, extends from the pipe divider 133. The front end pipe directs liquids from the tank 115 to the floor.

FIG. 13 shows the brake pedal 12, the brake pedal support 171, the drive pedal 29, the drive pedal support 172, a vacuum float gage 173, a switch panel 174, the foot switch 13, a junction box 175 (FIGS. 3 and 13), the master switch 167, a battery regulator 176 (FIGS. 3 and 13) and the battery or batteries 10 (FIGS. 3 and 13). An ammeter 177 and the waxing motor switch 178 are connected in the power circuit, as shown in FIG. 3.

FIG. 2 shows the left front wheel 2, a left front wheel trotter 179, a left front wheel trotter guide 180, the right front wheel trotter 181 and the right front wheel trotter guide 182. The wheels 2 and 3 are, as shown, pivotally mounted.

A motor connected shaft and gears 183 for the drive system and a connecting gear sleeve 184, shown in FIG. 6. A brushing motor shaft support 185, the drive motor 9, the motor connecting shaft and gears 183, a motor gear 186, the waxing motor 7, a support 187 for the waxing motor 7, a motor shaft 188, the motor shaft gear 94 and the wax plunger and shaft 149 are shown in FIG. 5. Axle supports 189, 190, 191, 192, 193, 194, 195, 196, 197, 198, 199 and 200 are shown in FIG. 5.

FIG. 14 shows the vacuum float gage 173 (FIGS. 13 and 14) and a vacuum gage pipe 201. One of six brush pins 202 and one of six brush pin keys 203 are shown in FIG. 6. A brake pedal support pin 204, a pin key 205, a push rod pin 206 and a push rod key 207 are shown in FIG. 6. A support pin 208 and a pin key 209 are shown in FIGS. 6 and 7. One of two yoke pins 210 and one of two yoke pin keys 211 are shown in FIG. 8.

While the invention has been described by means of a specific example and in a specific embodiment, I do not wish to be limited thereto, for obvious modifications will occur to those skilled in the art without departing from the spirit and scope of the invention.

I claim:

1. A floor maintenance machine, comprising a platform mounted on wheels;

an electric power system on the platform coupled to some of the wheels for driving the machine;

steering means on the platform coupled to selected ones of the wheels for steering the machine;

vacuum means on the platform connected to and operated by the electric power system for vacuuming a floor on which the machine is driven;

brushing means on the platform connected to and operated by the electric power system for performing selected operations on the floor, said brushing means comprising a plurality of brushes selectively manually coupled to the brushing means;

washing means on the platform for washing the floor, said washing means comprising a storage drum having two independent compartments, one containing a detergent and water solution and the other containing rinse water when washing and liquid wax when waxing;

waxing means on the platform connected to and operated by the electric power system for waxing the floor, said waxing means including a wax drum movably mounted on the platform, a wax plunger movably mounted on the wax drum, and control means coupled to the wax drum for selectively raising and lowering the wax drum out of and into contact with a surface supporting the machine and coupled to the wax plunger for selectively moving said wax plunger in axial directions in said wax drum; and machine control means coupled to the electric power system for selectively controlling the operation of the vacuum means, the brushing means and the waxing means.

2. A floor maintenance machine as claimed in claim 1, wherein the platform is mounted on two pivotally mounted front wheels and a pair of rear wheels and the steering means comprises a pair of brake devices each in proximity with a corresponding one of the rear wheels and each controlled individually in a manner whereby when one of the brake devices is actuated it brakes the corresponding wheel and the machine is turned in the corresponding direction and when both brake devices are actuated both wheels are braked and movement of the machine is halted.

3. A floor maintenance machine as claimed in claim 1, wherein the machine control means includes means for selectively raising and lowering the brushes.

4. A floor maintenance machine as claimed in claim 1, wherein the washing means includes outlet means for supplying liquid to the floor, said outlet means extending from the bottoms of the compartments of the storage drum toward the floor, blocking means in the outlet means for blocking the flow of liquid therethrough, and control means coupled to the blocking means for selectively controlling the blocking means to selectively permit and block the flow of water through the outlet means, said control means comprising rod means coupled to the blocking means.

5. A floor maintenance machine as claimed in claim 1, wherein the electric power system comprises battery means for supplying electrical energy, four electric motors and electric circuit means connecting the motors to the battery means for energization thereby, a first of the motors being coupled to and driving the vacuum means, a second of the motors being coupled to and driving the wax plunger of the waxing means, a third of the motors being coupled to and driving the brushing means and coupled to and driving the wax drum of the waxing means, and a fourth of the motors being coupled to and driving said some of the wheels.

* * * * *